US005749446A

United States Patent [19]

Hsieh

[11] Patent Number: 5,749,446

[45] Date of Patent: May 12, 1998

[54] COLLAPSIBLE LUGGAGE PIECE AND CART

[75] Inventor: Aquino Hsieh, Hangzhou, China

[73] Assignee: Jet General Investment Company, Lincolnwood, Ill.

[21] Appl. No.: 630,835

[22] Filed: Apr. 10, 1996

[51] Int. Cl.[6] ..... A45C 7/00; A45C 5/14; A45C 13/38

[52] U.S. Cl. ..... 190/107; 190/18 A; 190/103; 190/115; 190/127; 280/37

[58] Field of Search ..... 190/14, 21, 18 A, 190/103–105, 107, 115, 122, 125, 127; 383/2; 280/37, 655; 16/115

[56] References Cited

U.S. PATENT DOCUMENTS

| | | | |
|---|---|---|---|
| 202,850 | 4/1878 | McKinnon | 190/107 X |
| 736,871 | 8/1903 | O'Brien | 190/104 X |
| 2,425,035 | 8/1947 | Garnett et al. | 190/107 |
| 2,475,961 | 7/1949 | Hilbert | 190/105 |
| 2,538,616 | 1/1951 | Cross | 190/107 |
| 2,699,848 | 1/1955 | Kaplan | 190/107 X |
| 2,710,084 | 6/1955 | Braverman | 190/107 |
| 2,718,943 | 9/1955 | Braverman | 190/107 |
| 2,728,426 | 12/1955 | Dobyns | 190/107 |
| 2,919,138 | 12/1959 | Brower et al. | 190/18 A X |
| 4,588,056 | 5/1986 | Bernbaum | 190/107 |
| 4,589,530 | 5/1986 | Sher | 190/107 X |
| 4,953,673 | 9/1990 | Ambasz | 190/127 X |
| 5,050,713 | 9/1991 | Lee | 190/108 |
| 5,086,888 | 2/1992 | Chu | 190/107 |
| 5,103,945 | 4/1992 | Kaneko | 190/107 |
| 5,197,580 | 3/1993 | Berman et al. | 190/107 |
| 5,291,976 | 3/1994 | Ku | 190/18 A |
| 5,311,972 | 5/1994 | Plath | 190/102 |
| 5,377,794 | 1/1995 | Book | 190/107 X |
| 5,433,461 | 7/1995 | Chang | 190/18 A X |

FOREIGN PATENT DOCUMENTS

| | | | |
|---|---|---|---|
| 1185339 | 3/1970 | United Kingdom | 190/103 |
| 1208113 | 10/1970 | United Kingdom | 190/103 |
| 1500083 | 2/1978 | United Kingdom | 190/107 |

*Primary Examiner*—Sue A. Weaver
*Attorney, Agent, or Firm*—Emrich & Dithmar

[57] ABSTRACT

A collapsible luggage piece is provided. The luggage piece has a collapsed configuration and an erect configuration and includes a front panel, a rear panel and a collapsible wall structure disposed between the front and rear panels for cooperation therewith to define an expandable compartment. The wall structure has a first aperture therethrough and a first erecting panel is connected to the collapsible wall structure. The first erecting panel has a first locking element disposed thereon, wherein in the erect configuration the first erecting panel is substantially perpendicular to the rear panel and the first locking element is disposed through the aperture to rigidly attach the first erecting panel to the collapsible wall structure to maintain the luggage piece in the erect configuration and wherein in the collapsed configuration the first erecting panel is moved to a position not perpendicular to the rear panel to allow the luggage piece to collapse. The collapsible luggage piece can be releasably connected to a luggage cart having a connecting aperture by disposing the first locking element through the connecting aperture.

6 Claims, 4 Drawing Sheets

COLLAPSIBLE LUGGAGE PIECE AND CART

BACKGROUND OF THE INVENTION

1. Field of the Invention

This invention relates to luggage, and more particularly, to a collapsible luggage piece and cart combination.

2. Description of the Prior Art

In the past, luggage pieces have had wall structures which are collapsible to minimize the space necessary to store the luggage piece when not in use. These pieces had moveable rigid panels releasably connected to the internal surface of at least some of the walls of the wall structure to provide the luggage with strength and dimensional stability in use. Since the connection between the rigid panels and the walls of the luggage piece was internal, it was not always possible to tell from outside the piece if the rigid panels were in place to provide dimensional stability. If items were stacked on such a luggage piece when the walls were not connected to and not supported by the rigid panels, the luggage piece could collapse under the weight of the items stacked thereon causing these items to fall and be damaged.

Additionally, in the past, some of these collapsible luggage pieces have had rollers attached to their bottom wall to ease the transportability of the piece. These rollers, however, did not provide much stability and these luggage pieces often tipped over when they were being rolled.

SUMMARY OF THE INVENTION

It is a general object of the invention to provide an improved combination collapsible luggage piece and cart which avoids the disadvantages of prior combinations while affording additional structural operational advantages.

An important feature of the invention is the provision of a combination collapsible luggage piece and cart which is of a relatively simple and economical construction.

A still further feature of the invention is the provision of an improved combination collapsible luggage piece and cart which provides an indication that collapsible walls of the luggage piece are reinforced.

Yet another feature of the invention is the provision of a combination of the type set forth which has stability when it is rolled.

These and other features of the invention are attained by providing a collapsible luggage piece having a collapsed configuration and an erect configuration. The luggage piece includes a front panel, a rear panel and a collapsible wall structure disposed between the front and rear panels for cooperation therewith to define an expandable compartment. The wall structure has a first aperture therethrough, and a first erecting panel connected to the collapsible wall structure. The first erecting panel has a first locking element disposed thereon, wherein in the erect configuration the first erecting panel is substantially perpendicular to the rear panel and the first locking element is disposed through the aperture to rigidly attach the first erecting panel to the collapsible wall structure to maintain the luggage piece in the erect configuration and wherein in the collapsed configuration the first erecting panel is moved to a position not perpendicular to the rear panel to allow the luggage piece to collapse.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENTS

Figure 1:
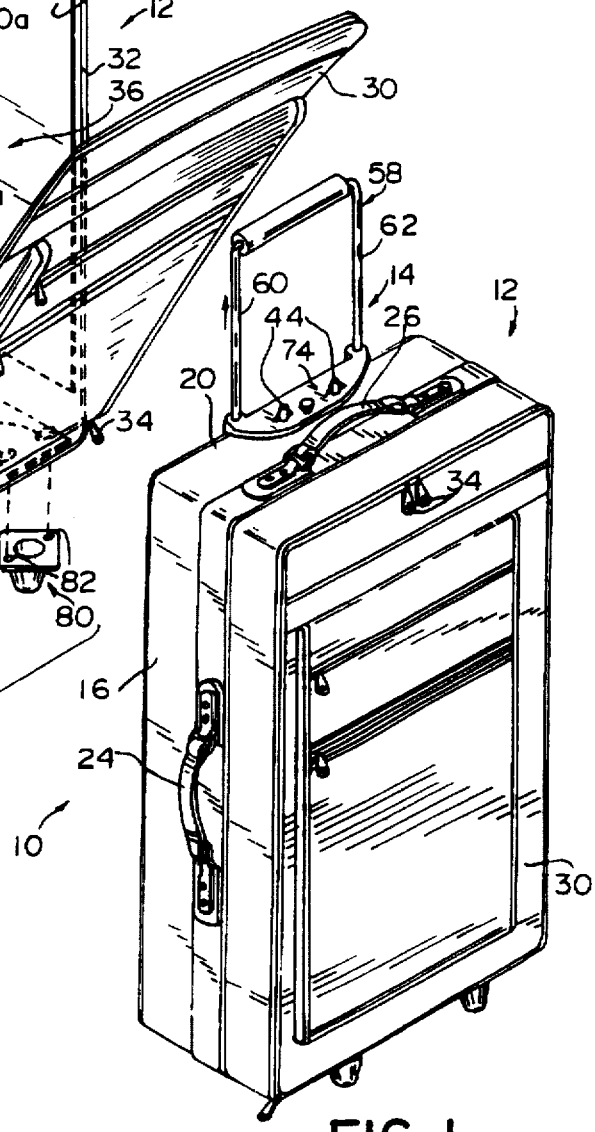
FIG. 1 is a perspective view of the luggage piece and cart combination of the present invention shown in a closed, erect configuration with the cart handle extended.

Referring to FIG. 1, a collapsible luggage piece and cart combination 10 is shown. The collapsible luggage piece and cart combination 10 includes a collapsible luggage piece 12 connected to a rollable luggage cart 14.

Figure 2:
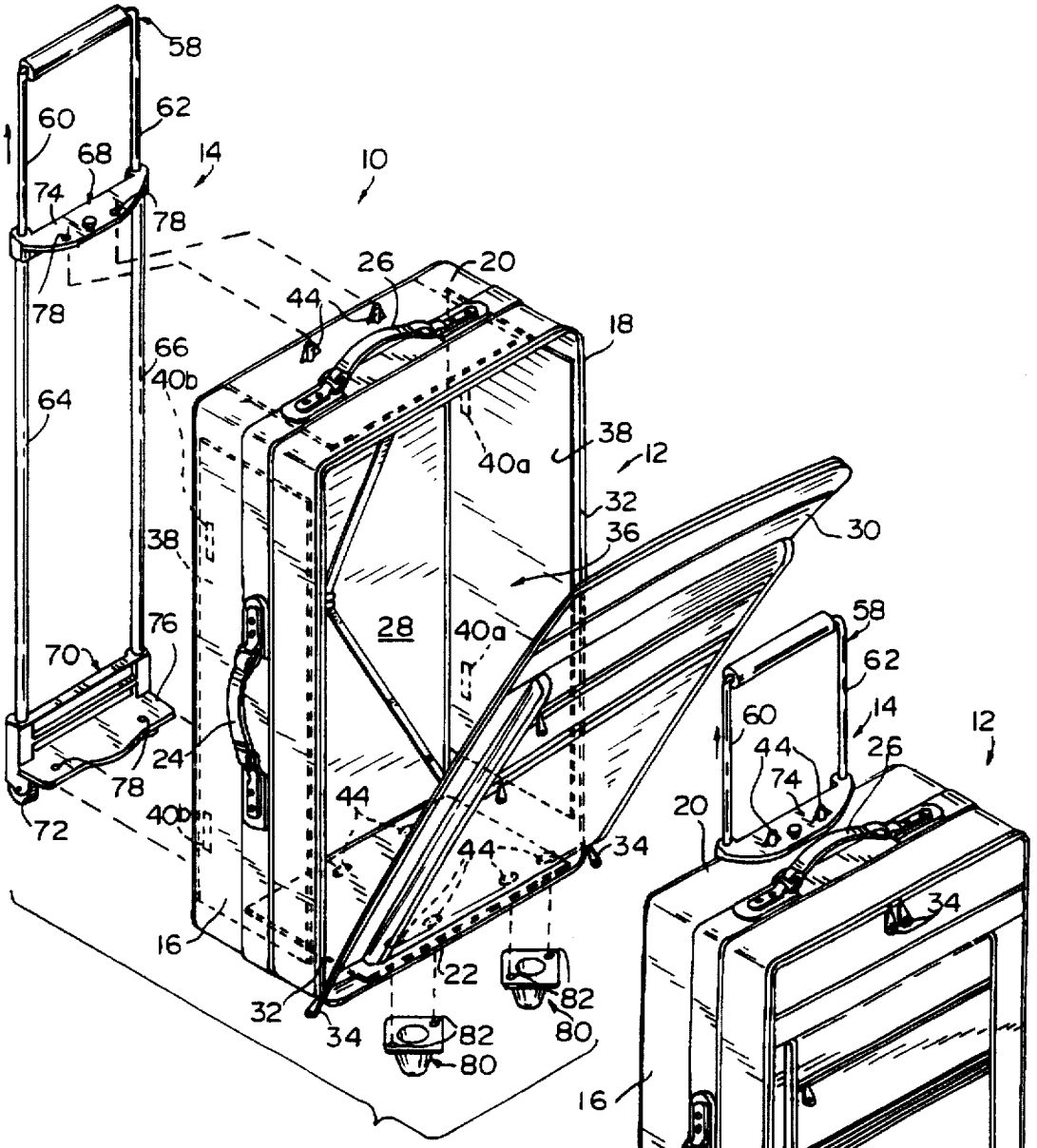
FIG. 2 is an exploded, perspective view of the luggage piece and cart combination of FIG. 1 with the luggage piece open.

As seen in FIG. 2, the luggage piece 12 includes two substantially parallel collapsible sidewalls 16, 18 and top and bottom collapsible walls 20, 22. A first conventional handle 24 is attached to the exterior surface of sidewall 16 and a second conventional handle 26 is attached to the exterior surface of the top wall 20. The four collapsible walls 16, 18, 20, 22 define a collapsible wall structure.

Figure 4:
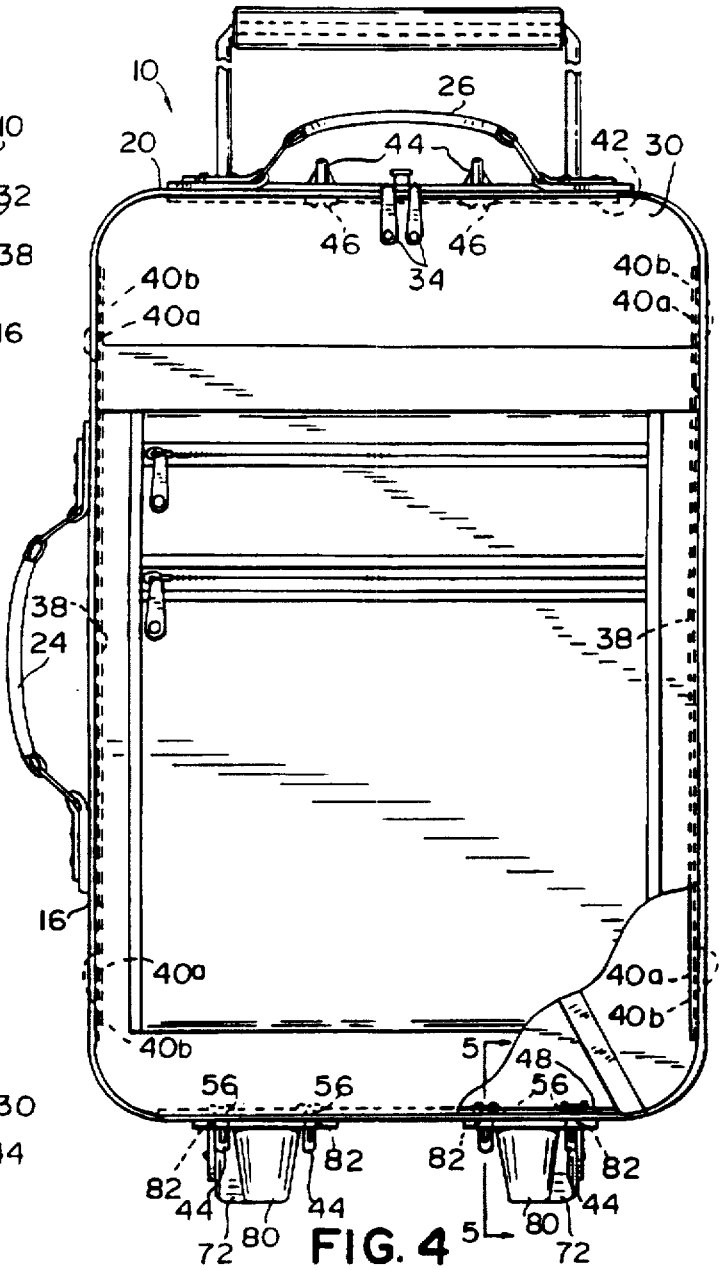
FIG. 4 is an enlarged, front elevational view of the luggage piece and cart combination of FIG. 1 in which the front panel has been partially broken away.
Figure 5:
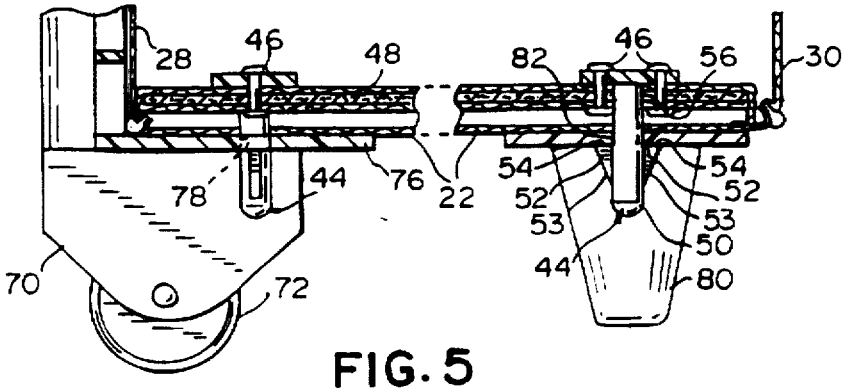
FIG. 5 is a further enlarged, fragmentary, sectional view taken generally along the line 5—5 of FIG. 4.
Figure 6:
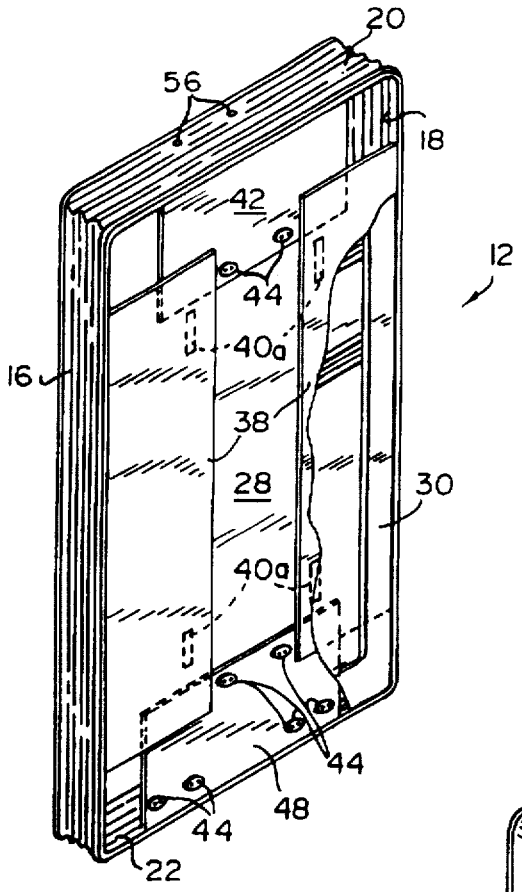
FIG. 6 is a perspective view of the luggage piece of FIG. 1 in its collapsed state, with the majority of the front panel broken away.

The luggage piece 12 has an erect configuration where, as seen in FIGS. 1–5, all the walls 16, 18, 20, 22 are substantially planar, and a collapsed configuration, as seen in FIG. 6, where the walls 16, 18, 20, 22 are folded upon themselves to conserve space.

The luggage piece 12 further includes a rear panel 28 attached by conventional means to and substantially perpendicular to the top wall 20, the bottom wall 22 and sidewalls 16, 18. The luggage piece 12 further includes a front panel 30 pivotally connected to the bottom wall 22 by conventional means and releasably connected to the top wall 20 and sidewalls 16, 18 by a zipper 32 running along an edge of each of the sidewalls 16, 18 and top wall 20 and having two sliding pieces 34. As seen in FIG. 1, when the sliding pieces 34 are placed next to one another the luggage piece 12 is placed in a closed condition and access to a compartment 36 formed by the top wall 20, bottom wall 22, sidewalls 16 and 18, the front panel 30 and the rear panel 28 is prevented.

When the sliding pieces 34 are spaced from one another, access to the compartment 36 can be gained. When, as seen in FIG. 2, the sliding pieces 34 are placed in their fully open position, one by the intersection of the sidewall 16 and the bottom wall 22 and the other by the intersection of sidewall 18 and bottom wall 22, the front panel 30 can be pivoted away from compartment 36 to allow full access thereto.

Figure 3:
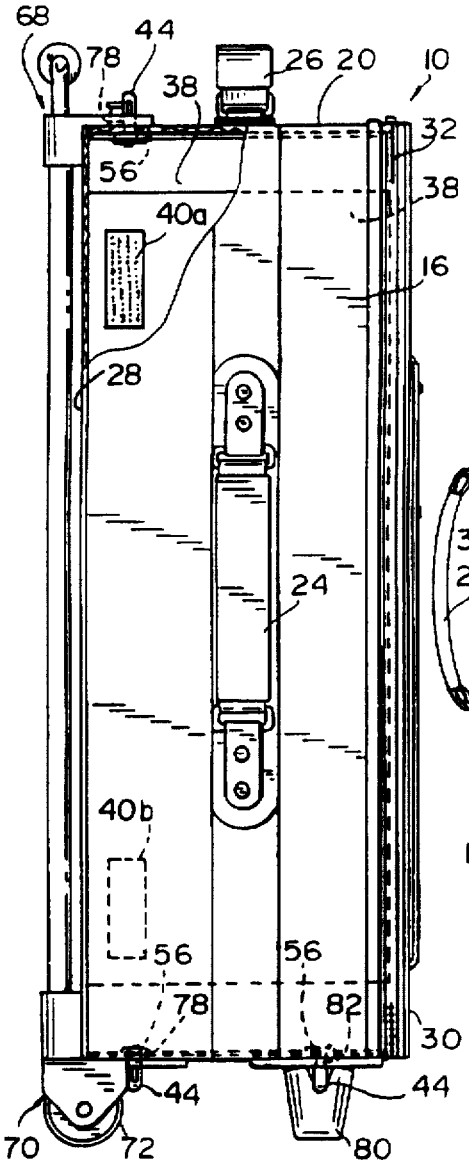
FIG. 3 is an enlarged, side elevational view of the luggage piece and cart combination of FIG. 1 where one of the sidewalls has been partially broken away and the cart handle is retracted.

The sidewalls 16, 18, the top wall 20 and the bottom wall 22 are formed of a material without much structural rigidity such as canvas, nylon or other material, so they can be collapsible. These walls, therefore, require a strengthening aid to maintain them in a planar state and prevent them from collapsing when a load is applied to them to maintain the luggage piece 12 in the erect configuration. Each of the sidewalls 16, 18, therefore, has a strengthening or an erecting side panel 38 pivotally connected, by stitching or other means, to an end of the sidewall 16, 18 closest to the zipper 32. Panels 38 are each releasably rigidly attached to one of the sidewalls 16, 18. As seen in FIGS. 2, 3, and 6, the panels 38 each have two engaging elements **40*a* and the sidewalls 16, 18 each have two mateable engageable elements 40*b* engageable with engageable elements 40*a* disposed on their interior surface. Engaging elements 40*a*, 40*b* can be hook and loop type fastener elements, such as Velcro, or other conventional fastener. When luggage piece 12 is in the erect configuration, each engageable element 40*a* is engaged with a respective engageable element 40*b* to rigidly attach each panel 38 to a respective sidewall 16, 18** substantially parallel thereto.

Similarly, the top wall 20 has a top erecting panel 42 pivotally connected, by stitching or other means, to an end thereof closest to the zipper 32. The top erecting panel 42 has a pair of locking elements 44, each connected thereto by a pair of rivets 46.

Likewise, the bottom wall 22 has a bottom erecting panel 48 pivotally connected to an end thereof closest to the zipper 32. The bottom erecting panel 48, as best seen in FIGS. 3–6, has six locking elements 44, each connected thereto by a pair of rivets 46. When the luggage piece 12, as seen in FIG. 2, is in the erect configuration, two of the locking elements 44 on the erecting panel 48 are disposed closest to the rear panel 28 and the remaining four locking elements 44 on the erecting panel 48 are disposed closest to the front panel 30.

The locking elements 44 connected to the top and bottom erecting panels 42, 48 are identical and may be made out of a durable, light-weight plastic. Each of the locking elements 44 includes, as best seen in FIG. 5, a substantially cylindrical post 50 and a pair of diametrically opposed, triangular-shaped moveable elements 52, each having a cam surface 53 and a shoulder surface 54. The triangular-shaped moveable elements 52 can be moved so that the shoulder surfaces 54 can lie completely within the outer periphery of the cylindrical post 50. The triangular-shaped moveable elements 52 are, however, biased to lie outside the outer periphery of the cylindrical post 50.

When the luggage piece 12 is in the erect configuration, each locking element 44 disposed in the top erecting panel 42 is disposed through a corresponding aperture 56 located in the top wall 20 and each locking element 44 disposed in the bottom erecting panel 48 is disposed through a corresponding aperture 56 in the bottom wall 22. Each aperture 56 is circular and has a diameter or width smaller than the outer ends of the shoulder surface 54 when the triangular-shaped moveable elements 52 are in their normal biased position. Each locking element 44 is disposed through an aperture 56 by pushing the triangular-shaped moveable elements toward the cylindrical post 50, so that the outer ends of the shoulder surfaces 54 can be inserted through an aperture 56, and then releasing the triangular-shaped moveable elements 52 so that they return to their biased state and the outer ends of the shoulder surfaces 54 are separated by a distance greater than the width or diameter of the aperture 56, thereby rigidly attaching and locking the top erecting panel 42 and the bottom erecting panel 48 respectively to the top wall 20 and the bottom wall 22, substantially parallel thereto.

Since the cylindrical posts 50 and the triangular-shaped moveable elements 52 are disposed outside the compartment 36 when the luggage piece 12 is in the erect configuration, a user can simply view the exterior of the luggage piece 12 to determine if the top erecting panel 42 and bottom erecting panel 48 are rigidly attached to the top and bottom walls 20, 22 without any need to gain access to the compartment 36.

Each of the side, top and bottom erecting panels 38, 42, 48 may include a rigid, platelike rectangular member made out of strong material like a metal or a hard plastic, capable of providing strength to the collapsible wall structure, and may be covered with the same material the walls 16, 18, 20, 22 are constructed of. The covering material is then stitched to a respective wall 16, 18, 20 or 22 to pivotally connect the respective erecting panel thereto. As discussed above, when the luggage piece 12 is in the erect configuration, each wall 16, 18, 20 and 22 is substantially planar and has an erecting panel rigidly attached and substantially parallel thereto to provide it with dimensional stability.

The luggage piece 12 can advantageously be connected to the luggage cart 14 to aid in transporting the luggage piece 12. As seen in FIGS. 2–5, the luggage cart 14 has a telescoping handle 58 having first and second rods 60, 62 respectively slideably connected to first and second hollow fixed rods 64, 66. The telescoping handle 58 is moveable between a retracted position, as shown in FIG. 3, and an extended position, as shown in FIGS. 1, 2 and 4. The luggage cart 14 also includes an upper bracket 68 connecting the upper ends of the first and second fixed hollow rods 64, 66 and a bottom bracket having a pair of rollers 72 and connecting the lower ends of the first and second fixed rods 64, 66. The upper bracket 68 and bottom bracket 70 respectively have an upper connecting member 74 and a lower connecting member 76, each having a pair of connecting apertures 78 having the same, or substantially the same, diameter as apertures 56. As seen best in FIGS. 2 and 3, the upper connecting member 74 is substantially parallel to the lower connecting member 76.

As seen in FIGS. 3 and 5, when the luggage piece 12 is connected to the luggage cart 14, the locking elements 44 connected to the top erecting panel 42 are disposed through the connecting apertures 78 disposed on the upper connecting member 74 and the two locking elements 44 connected to bottom erecting panel 48 closest to the rear panel 28 are disposed through the connecting apertures 78 in the lower connecting member 76 in the same manner the locking elements 44 were disposed through the apertures 56 of the luggage piece 12 to connect the luggage piece 12 to the luggage cart 14.

The collapsible luggage piece and cart combination 10 also incudes a pair of stabilizers 80, each having a pair of stabilizer apertures 82 having a diameter substantially equal to the diameter of the apertures 56 of the luggage piece 12. The pair of locking elements 44 connected to the bottom erecting panel 48 are respectively disposed through pairs of stabilizer apertures 82 to connect the stabilizers 80 to the luggage piece 12. The connected stabilizers 80 allow the top and bottom walls 20, 22 to be substantially parallel to the ground and aid in preventing the collapsible luggage piece and cart combination 10 from tipping over.

When it is desired to collapse the luggage piece 12, as seen in FIG. 6, each pair of engaging elements 40*a*, 40*b* disposed in the side erecting panels 38 and the sidewalls 16, 18 are disengaged from one another and the two side erecting panels 38 are pivoted away from the sidewalls and toward the front panel 30 to a position not perpendicular to the rear panel 28.

Also, the triangular-shaped moveable elements 52 of each locking element 44 connected to the top erecting panel 42 are pushed together so that the outer ends of the shoulder surfaces 54 are at a distance less than the width of the respective aperture 56 in the top wall 20 of the luggage piece 12 and the respective connecting aperture 78 of the upper connecting member 74 that each locking element 44 is disposed through. Each locking element 44 is then pushed downwardly through both the respective aperture 56 and the respective connecting aperture 78 to disengage the luggage piece 12 from the upper connecting member 74. The top erecting panel 42 is then allowed to and is pivoted away from the top wall 20 and toward the front panel 30 to a position not perpendicular with the rear panel 28.

Further, the two locking elements 44 connecting the luggage piece 12 to the lower connecting member 76 are similarly pushed upwardly through both a respective connecting aperture 78 of the lower connecting member 76 and a respective aperture 56. Likewise, the four locking elements 44 connecting the stabilizers 80 to the luggage piece 12 are each pushed upwardly through a respective stabilizer aperture 82 and an aperture 56. This allows the luggage piece 12 to be disengaged from both the lower connecting member 76 and the stabilizers 80. The bottom erecting panel 48 is thus allowed to and is pivoted away from the bottom wall 22 toward the front panel 30 so that the bottom erecting panel 48 is not perpendicular with the rear panel 28.

Since the four erecting panels 38, 42, 48 are now not rigidly attached to the sidewalls 16, 18, top wall 20 or bottom wall 22 and are not perpendicular to the rear panel 28, the wall structure can collapse, as seen in FIG. 6, allowing the front panel 30 to move closer to the rear panel 28 to conserve space when the luggage piece 12 is stored. Additionally, if desired, the stabilizers 80 can be placed in the collapsed compartment 36 so they are not lost.

Figure 8:
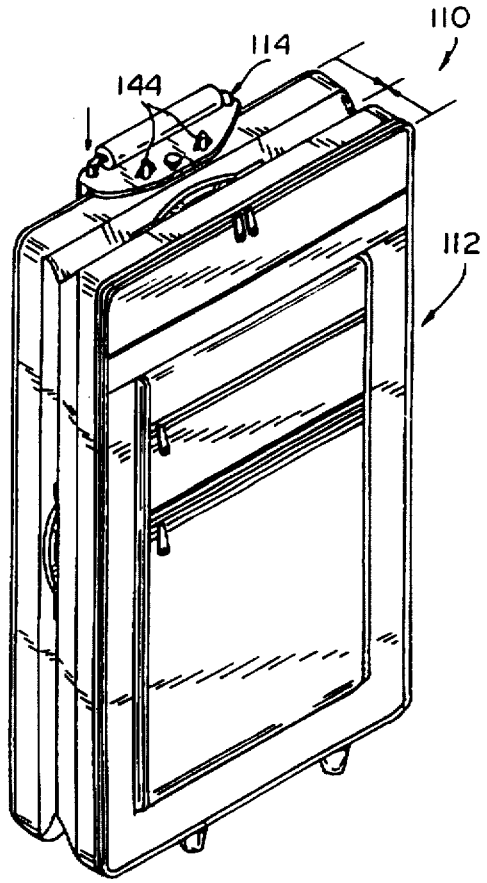
FIG. 8 is a perspective view of the luggage piece and cart combination of FIG. 7 after the luggage piece has been collapsed.
Figure 7:
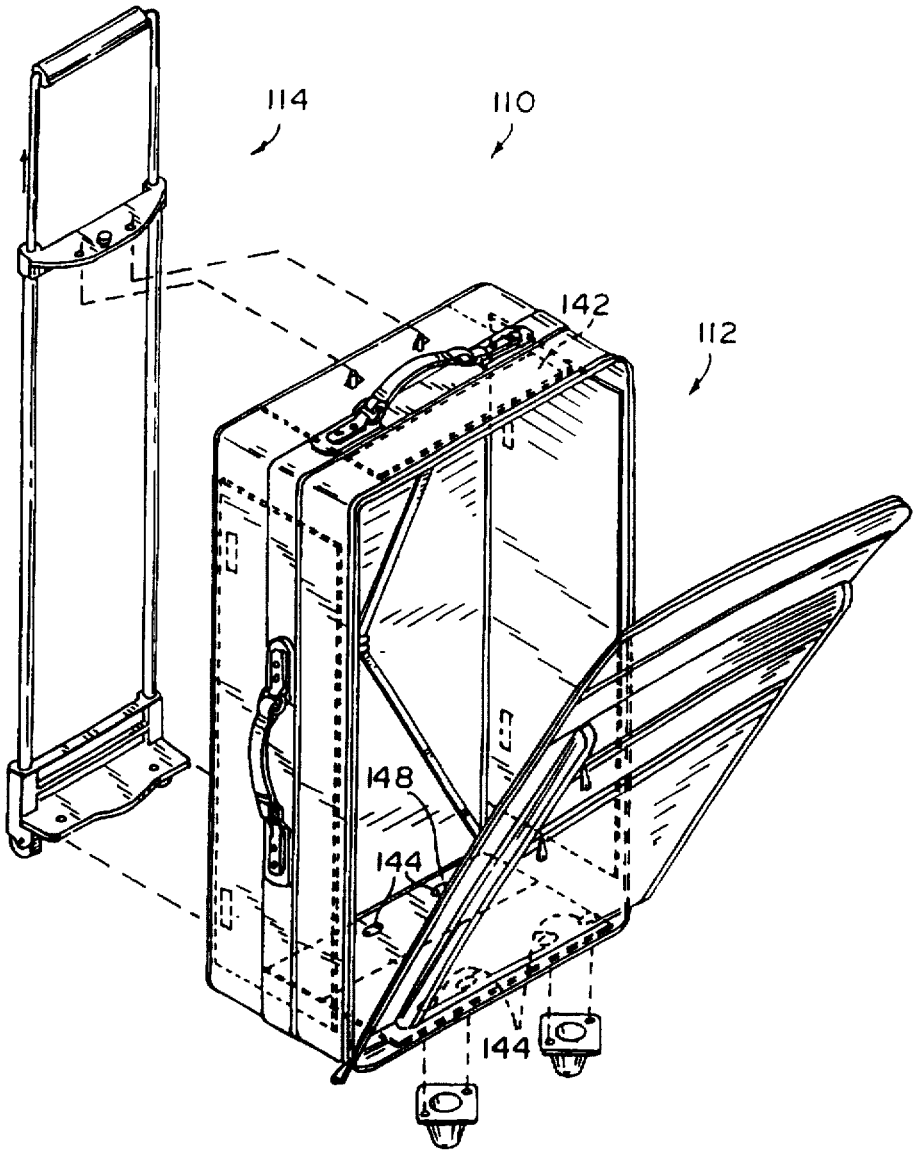
FIG. 7 is an exploded, perspective view, similar to FIG. 2, of a second embodiment of the luggage piece and cart combination of the present invention.

A second collapsible luggage piece and cart combination 110 of the present invention is illustrated in FIGS. 7 and 8. The collapsible luggage piece and cart combination 110 has a luggage piece 112 and a luggage cart 114 and is identical to the collapsible luggage piece and cart combination 10 shown in FIGS. 1–6 except that it has a top erecting panel 142 and a bottom erecting panel 148, each having a fold line, or other means, which allows locking elements 144 connected to the top erecting panel 142 and the bottom erecting panel 148 to stay disposed through connecting apertures 178 located in upper and lower connecting members 174, 176. This allows the luggage piece 112 to be collapsed, but remain connected to the luggage cart 114.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A collapsible luggage piece and cart combination having an assembled state and an unassembled state, the combination comprising:

a collapsible luggage body having a collapsed configuration and an erect configuration, the body comprising a front panel, a rear panel, a collapsible wall structure disposed between the front and rear panels for cooperation therewith to define an expandable compartment, the wall structure having a first aperture therethrough, a first erecting panel connected to the collapsible wall structure, the first erecting panel having a first locking element disposed thereon, wherein in the erect configuration the first erecting panel is substantially perpendicular to the rear panel and the first locking element is disposed through the first aperture to rigidly attached to the collapsible wall structure to maintain the luggage body in the erect configuration and wherein in the collapsed configuration at least a portion of the first erecting panel is moved to a position not perpendicular to the rear panel to allow the luggage body to collapse; and a luggage cart having a first connecting member having a first connecting aperture, wherein in the assembled state the first locking element is disposed through the first aperture and the first connecting aperture, whereby the body is releasably connected to the luggage cart.

2. The combination of claim 1, wherein the cart further includes a second connecting member having a second connecting aperture, and the collapsible wall structure includes a second aperture and the luggage body further comprises a second erecting panel connected to the collapsible wall structure, the second erecting panel having a second locking element disposed thereon, wherein in the erect configuration the second erecting panel is substantially perpendicular to the rear panel and the second locking element is disposed through the second aperture to rigidly attached to the collapsible wall structure to aid in maintaining the luggage body in the erect configuration and wherein in the collapsed configuration at least a portion of the second erecting panel is moved to a position not perpendicular to the rear panel to allow the luggage piece to collapse and wherein in the assembled state the second locking element is disposed through the second aperture and the second connecting aperture to further aid in releasably connecting the luggage body to the luggage cart.

3. The combination of claim 2, wherein each of the first and second connecting apertures has a width and each of the first and second locking elements has two diametrically opposed moveable shoulder surfaces having outer ends, wherein in the assembled state the outer ends of the two moveable shoulder surfaces of the first locking element are separated by a distance greater than the width of the first connecting aperture and are disposed outside the compartment, and the outer ends of the two moveable shoulder surfaces of the second locking element are separated by a distance greater than the width of the second connecting aperture and are disposed outside the compartment.

4. The combination of claim 2, wherein the body further comprises third and fourth erecting panels connected to the collapsible wall structure, wherein in the erect configuration the third and fourth erecting panels are respectively rigidly connected to the collapsible wall structure and substantially perpendicular to the rear panel and in the collapsed configuration the third and fourth erecting panels are moved to a position not perpendicular to the rear panel to allow the luggage body to collapse.

5. The combination of claim 4, wherein the first and second connecting members are substantially parallel to each other and the collapsible wall structure includes first and second collapsible walls respectively having the first and second apertures formed therethrough, and in the assembled state, the first and second collapsible walls are substantially parallel to each other and to the first and second connecting members.

6. The combination of claim 4, wherein in the erect configuration, the first and second erecting panels are substantially perpendicular to the third and fourth erecting panels.

* * * * *